US008197237B2

(12) United States Patent
Lin et al.

(10) Patent No.: US 8,197,237 B2
(45) Date of Patent: Jun. 12, 2012

(54) METERING PUMP AND DRIVE DEVICE THEREOF

(76) Inventors: Bo Lin, Chengdu (CN); Jiang Lin, Chengdu (CN)

( * ) Notice: Subject to any disclaimer, the term of this patent is extended or adjusted under 35 U.S.C. 154(b) by 134 days.

(21) Appl. No.: 12/854,193

(22) Filed: Aug. 11, 2010

(65) Prior Publication Data

US 2010/0303656 A1 Dec. 2, 2010

Related U.S. Application Data

(63) Continuation of application No. PCT/CN2008/071796, filed on Jul. 29, 2008.

(30) Foreign Application Priority Data

Apr. 30, 2008 (CN) ..... 2008 1 0044323

(51) Int. Cl.
*F04B 7/04* (2006.01)

(52) U.S. Cl. ..... 417/498; 92/51; 417/511; 417/518; 417/520

(58) Field of Classification Search ..... 417/496, 417/498, 499, 511, 518, 520; 92/51; 251/325
See application file for complete search history.

(56) References Cited

U.S. PATENT DOCUMENTS 1,504,038 A * 8/1924 Geaslen ..... 137/357
5,309,934 A * 5/1994 Jaeger ..... 137/1

* cited by examiner

*Primary Examiner* — Devon C Kramer
*Assistant Examiner* — Ryan Gatzemeyer
(74) *Attorney, Agent, or Firm* — Matthias Scholl P.C.; Matthias Scholl

(57) ABSTRACT

A drive device, comprising a housing, a rod, a limiting device, a sliding block, a rotating block, a pair of springs, a pair of first grooves, and a second groove. The rod passes through the sliding block, an axis is disposed on the sliding block, the rotating block is disposed on the axis, the springs are disposed on both sides of the rotating block, the top of the spring is contacted with one side of the rotating block, the first grooves are disposed on one side of the rod opposite to the housing, the second groove is disposed on inner side of the housing opposite to the first groove, a middle part of the second groove is lower than other parts thereof, one end of the rotating block slides in the second groove, and the other end of the rotating block slides in and between the first grooves.

19 Claims, 9 Drawing Sheets

METERING PUMP AND DRIVE DEVICE THEREOF

CROSS-REFERENCE TO RELATED APPLICATIONS

This application is a continuation of International Patent Application No. PCT/CN2008/071796 with an international filing date of Jul. 29, 2008, designating the United States, now pending, and further claims priority benefits to Chinese Patent Application No. 200810044323.5 filed on Apr. 30, 2008. The contents of all of the aforementioned applications, including any intervening amendments thereto, are incorporated herein by reference.

BACKGROUND OF THE INVENTION

1. Field of the Invention

The invention relates to a pump and a drive device thereof, and more particularly to a metering pump and a drive device thereof.

2. Description of the Related Art

Metering pumps are widely used nowadays, and most of them use one-way valves as switches. However, there are several problems with the conventional metering pump: firstly, the one-way valve can only be switched on or off as pressure applied thereon is greater than elastic recovery force thereof, which is inconvenient for microsampling or chemical dosing; secondly, the one-way often fails as impurities exist; thirdly, the one-way often fails due to pressure at a liquid-inlet hole and a liquid-outlet hole.

To overcome the above-mentioned problems, another metering pump is invented. The metering pump comprises a plunger, a plunger sleeve, a liquid-inlet hole, a liquid-outlet hole, and a pump body. The plunger sleeve is disposed in the pump body and rotates therein. The plunger reciprocally slides in the plunger sleeve. As the liquid-inlet hole or the liquid-outlet hole on the plunger sleeve reaches a corresponding position on the pump body, connection between a pump cavity and a liquid-inlet channel or a liquid-outlet channel is established. Since no one-way valve is used, measurement deviation caused thereby is prevented. However, since the plunger sleeve rotates in the pump body, requirements for sealing and fitting accuracy between the liquid-inlet hole or the liquid-outlet hole and the pump body are high, which makes production of the metering pump difficult. In addition, moving tracks of the liquid-inlet hole and the liquid-outlet hole in the pump body are circular, and sealing gap therebetween cannot be easily adjusted. Lastly, since the plunger cannot deliver all liquid in the plunger sleeve to the outside over a complete travel distance, metering deviation occurs due to residual liquid.

SUMMARY OF THE INVENTION

In view of the above-described problem, it is one objective of the invention to provide a metering pump capable of addressing the above-mentioned problems.

It is another objective of the invention to provide a drive device for a metering pump capable of addressing the above-mentioned problems.

To achieve the above objectives, in accordance with one embodiment of the invention, provided is a metering pump, comprising a pump sleeve comprising a liquid-inlet hole and a liquid-outlet hole, a pump body comprising a cavity and a diversion outlet, a plunger, and a drive device, comprising a housing, a rod, a limiting device, a sliding block, a rotating block, a pair of springs, a pair of first grooves, and a second groove. The pump body is movably disposed in the pump sleeve, the plunger is disposed in the cavity of the pump body, the diversion outlet is disposed on a side wall of the pump body and connected to the cavity, the liquid-inlet hole and the liquid-outlet hole are opposite to the diversion outlet, the diversion outlet is alternatively aligned with the liquid-inlet hole and the liquid-outlet hole, the housing is fixedly connected to the pump sleeve, the rod is fixed to the pump body, the limiting device operates to limit travel distance of the pump body, the sliding block is movably disposed in the housing, the plunger is fixedly connected to the sliding block, the rod passes through the sliding block, an axis is disposed on the sliding block, the rotating block is disposed on the axis, the springs are disposed on both sides of the rotating block, the top of the spring is contacted with one side of the rotating block, the first grooves are disposed on one side of the rod opposite to the housing, the second groove is disposed on inner side of the housing opposite to the first groove, a middle part of the second groove is lower than other parts thereof, one end of the rotating block slides in the second groove, and the other end of the rotating block slides in and between the first grooves.

In a class of this embodiment, the diversion outlet is disposed on a tail-end of the pump body.

In a class of this embodiment, a sealing ring is disposed on inner side of the pump sleeve, and operates to fix the pump body to the pump sleeve.

In a class of this embodiment, a sealing strip is disposed on inner side of the pump sleeve, and operates to fix the pump body to the pump sleeve.

In a class of this embodiment, a sealing loop is disposed between the inner wall of the cavity and the plunger.

In a class of this embodiment, an elastic device is disposed between the pump body and the pump sleeve and opposite to the liquid-inlet hole and the liquid-outlet hole.

In a class of this embodiment, a thread hole is disposed on the pump sleeve and at the bottom of the elastic device, and an adjusting screw is disposed in the thread hole.

In a class of this embodiment, the sliding block is driven via linkage parts and moves reciprocally.

In a class of this embodiment, the linkage parts comprise a runner disposed on a rotating shaft of a motor, and an axle pin disposed on the edge of the runner.

In a class of this embodiment, the other end of the axle pin is fit on the sliding block.

In a class of this embodiment, the number of the rods is two, and the rods are symmetrically distributed with respect to the plunger.

In a class of this embodiment, the middle of a cross section of the rotating block is rectangular, and the other ends of the cross section of the rotating block are triangular.

In accordance with one embodiment of the invention, provided is a drive device, comprising a housing, a rod, a limiting device, a sliding block, a rotating block, a pair of springs, a pair of first grooves, and a second groove. The rod passes through the sliding block, an axis is disposed on the sliding block, the rotating block is disposed on the axis, the springs are disposed on both sides of the rotating block, the top of the spring is contacted with one side of the rotating block, the first grooves are disposed on one side of the rod opposite to the housing, the second groove is disposed on inner side of the housing opposite to the first groove, a middle part of the second groove is lower than other parts thereof, one end of the rotating block slides in the second groove, and the other end of the rotating block slides in and between the first grooves.

In a class of this embodiment, the sliding block is driven via linkage parts and moves reciprocally.

In a class of this embodiment, the linkage parts comprise a runner disposed on a rotating shaft of a motor, and an axle pin disposed on the edge of the runner.

In a class of this embodiment, the other end of the axle pin is fit on the sliding block.

In a class of this embodiment, the number of the rods is two, and the rods are symmetrically distributed with respect to the plunger.

In a class of this embodiment, the middle of a cross section of the rotating block is rectangular, and the other ends of the cross section of the rotating block are triangular.

In a class of this embodiment, the limiting device comprises a limiting block and a limiting ring, the limiting ring is disposed on a tail-end of the pump body, and cooperates with said pump sleeve to limit movement of said pump body, and said limiting block is disposed to the right of said housing, and operates to limit movement of said rod.

Advantages of the invention comprise:

1) switching between liquid outlet and liquid inlet is implemented by movement of the pump body with respect to the pump sleeve, and problems caused by the conventional one-way valve no longer exist.

2) amount of liquid that is delivered by the metering pump over a complete travel distance is determined by an inner diameter $\phi$ of the pump body and a movement distance of a plunger, and thus it is fixed, which implements accurate metering of the metering pump; moreover, the metering pump can be made small (for example, if a diameter of the plunger is 1 mm and a travel distance thereof is 2 mm, 1.57 mL liquid can be absorbed and discharged, and 3.93 mL liquid can be absorbed and discharged if a travel distance of the plunger is 5 mm) and is suitable for microsampling or chemical dosing;

3) impurities in the liquid do not affect operation of the metering pump as long as they do not cause blocking.

In which:

1—plunger; 2—pump body; 3—pump sleeve; 4—sliding block; 5—rod; 6—housing; 7—rotating block; 8—spring; 9—liquid-inlet hole; 10—liquid-outlet hole; 11—diversion outlet; 12—motor; 13—runner; 14—axle pin; 15—sealing strip; 16—adjusting screw; 17—sealing loop; 18—limiting block; 19—limiting ring; 20—elastic device; 21—cavity; 22—second groove; 23—first groove

DETAILED DESCRIPTION OF THE EMBODIMENTS

Detailed description will be given below in conjunction with accompanying drawings and embodiments.

Figure 1:
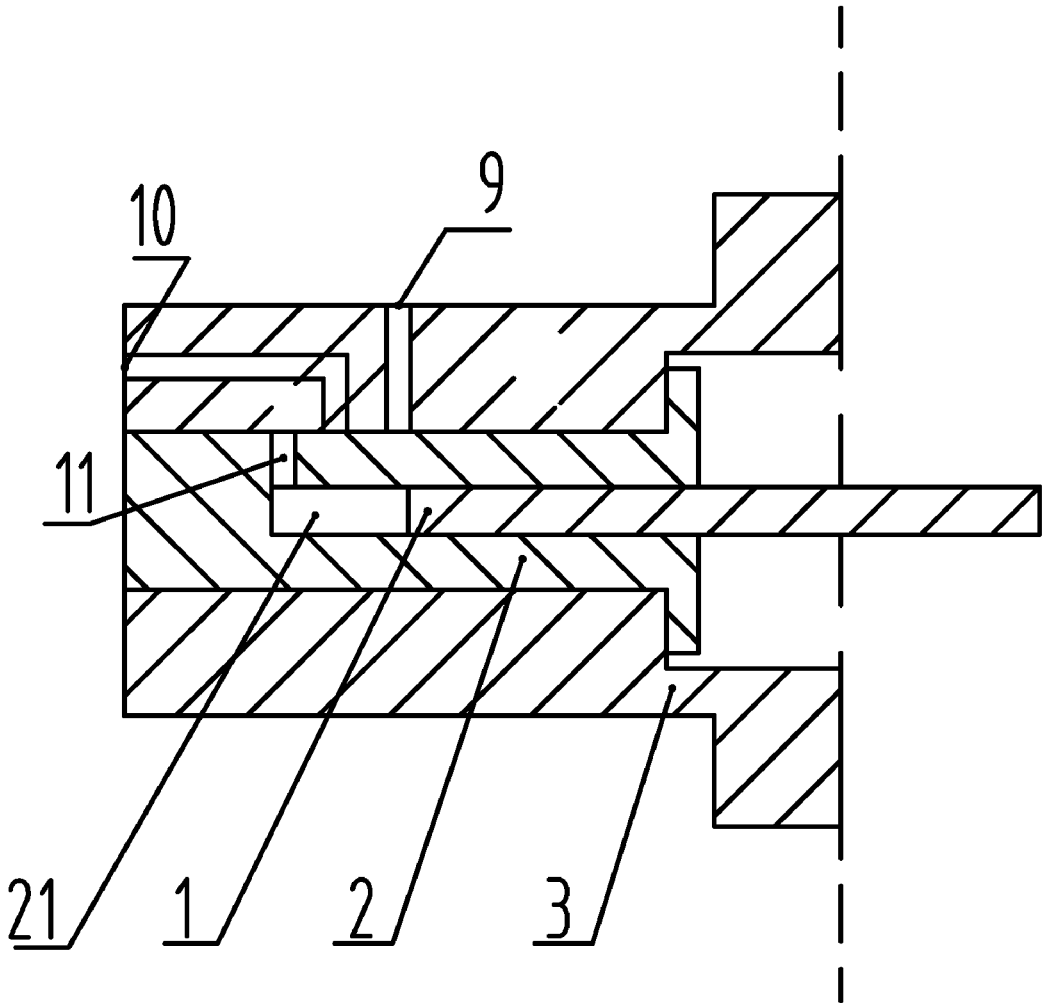
FIG. 1 is a cross-sectional view of a metering pump of a first embodiment of the invention.

As shown in FIG. 1, a metering device of a first embodiment of the invention comprises a drive device (not shown), a pump sleeve 3 comprising a liquid-inlet hole 9 and a liquid-outlet hole 10, a pump body 2 comprising a cavity 21 and a diversion outlet 11, and a plunger 1.

The pump body 2 is movably disposed in the pump sleeve 3.

The plunger 1 is disposed in the cavity 21 of the pump body 2.

The diversion outlet 11 is disposed on a side wall of the pump body 2 and connected to the cavity 21.

The diversion outlet 11 is disposed on a tail-end of the pump body 2.

The liquid-inlet hole 9 and the liquid-outlet hole 10 are opposite to the diversion outlet 11, and the diversion outlet 11 is alternatively aligned with the liquid-inlet hole 9 and the liquid-outlet hole 10.

Figure 2:
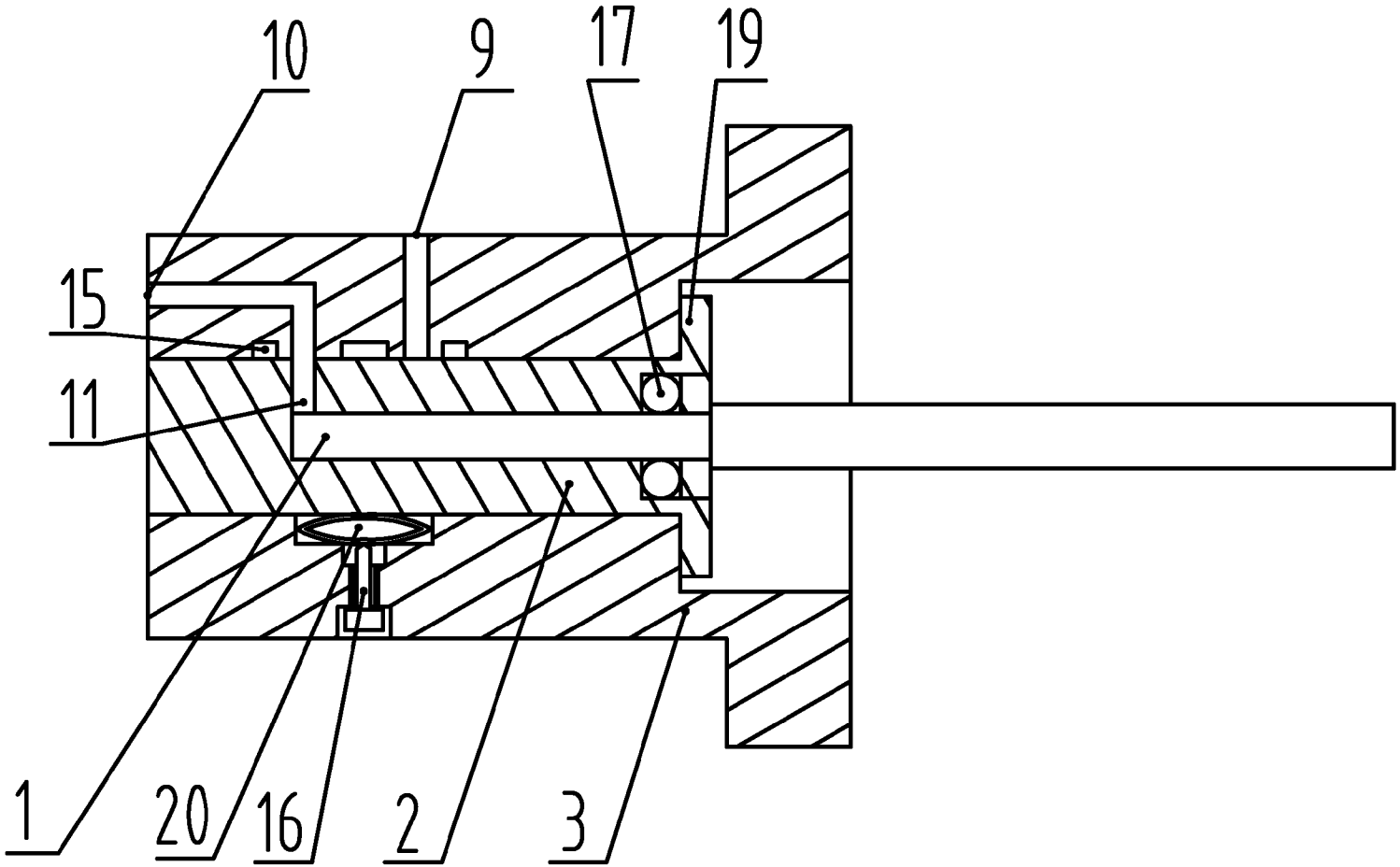
FIG. 2 is a cross-sectional view of a metering pump of a second embodiment of the invention.

As shown in FIG. 2, a metering device of a second embodiment of the invention is illustrated. The difference the metering device and that of a first embodiment is that, a sealing strip 15 is disposed on inner side of the pump sleeve 3, and operates to fix the pump body 2 to the pump sleeve 3. An elastic device 20 is disposed between the pump sleeve 3 and the pump body 2, and operates to provide elastic force whereby fixing the top of the pump body 2 to the pump sleeve 3. A screw hole is disposed on the pump sleeve 3 at the bottom of the elastic device 20. An adjusting screw 16 is disposed in the screw hole, and adjustment of the elastic force is implemented by movement of the adjusting screw 16 whereby adjusting pressure between the pump body 2 and the top of the pump sleeve 3 and facilitating sealing. A sealing loop 17 is disposed at an opening on the right of the pump body 2.

Movement of the plunger 1 and the pump body 2 is implemented by several step motors controlled via programmable logical controllers (PLCs).

Figure 3:
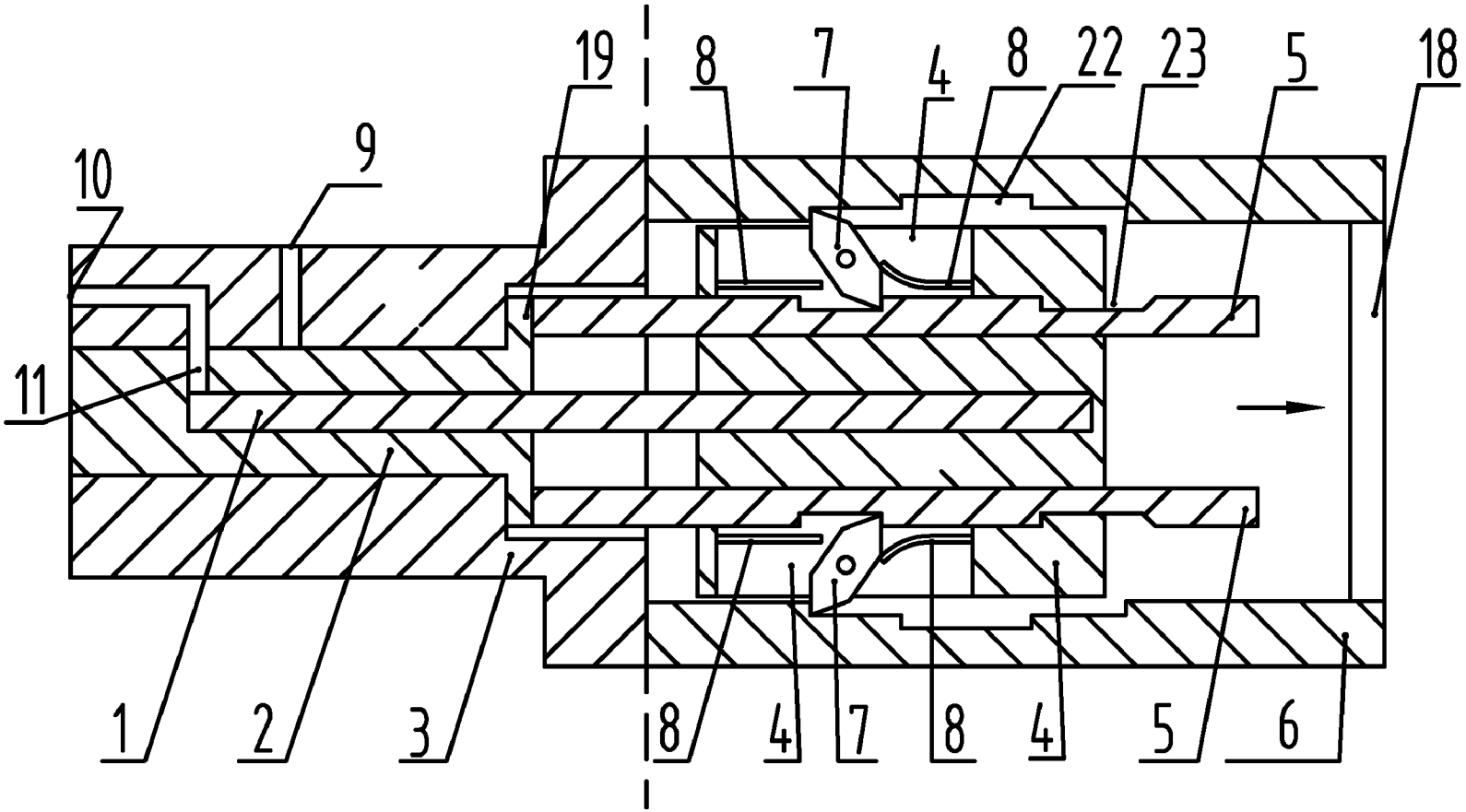
FIG. 3 is a cross-sectional view of a metering pump with a drive device of a third embodiment of the invention.

As shown in FIG. 3, a metering device of a third embodiment of the invention is illustrated. The difference the metering device and that of a first embodiment is that, a sealing strip 15 is disposed on inner side of the pump sleeve 3, and operates to fix the pump body 2 to the pump sleeve 3. To ensure stable sliding of the pump body 2 in the pump sleeve 3, a part of the pump body 2 sliding in the pump sleeve 3 is rectangular or approximately rectangular.

Figure 4:
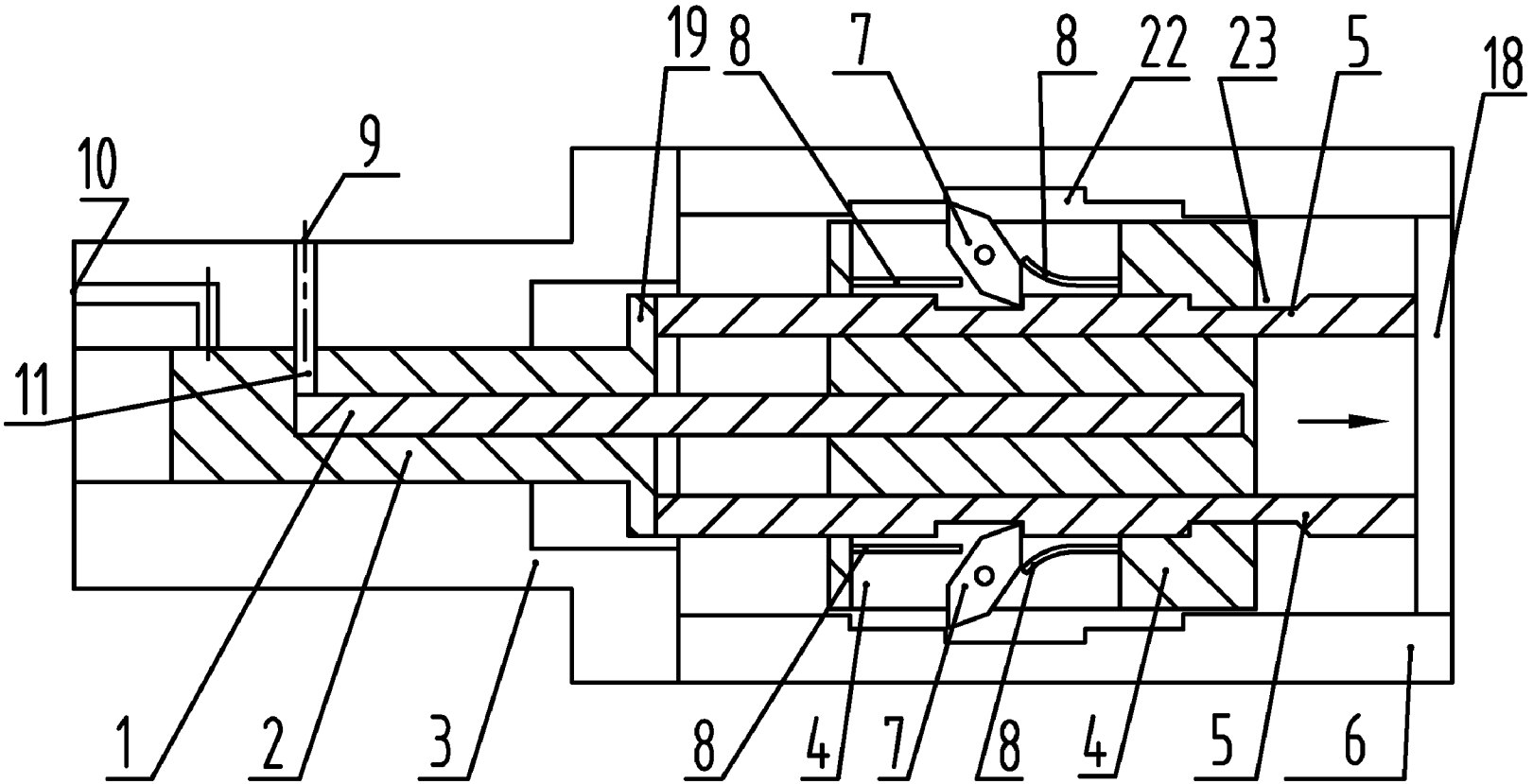
FIG. 4 is a cross-sectional view of a metering pump absorbing liquid in FIG. 3.
Figure 5:
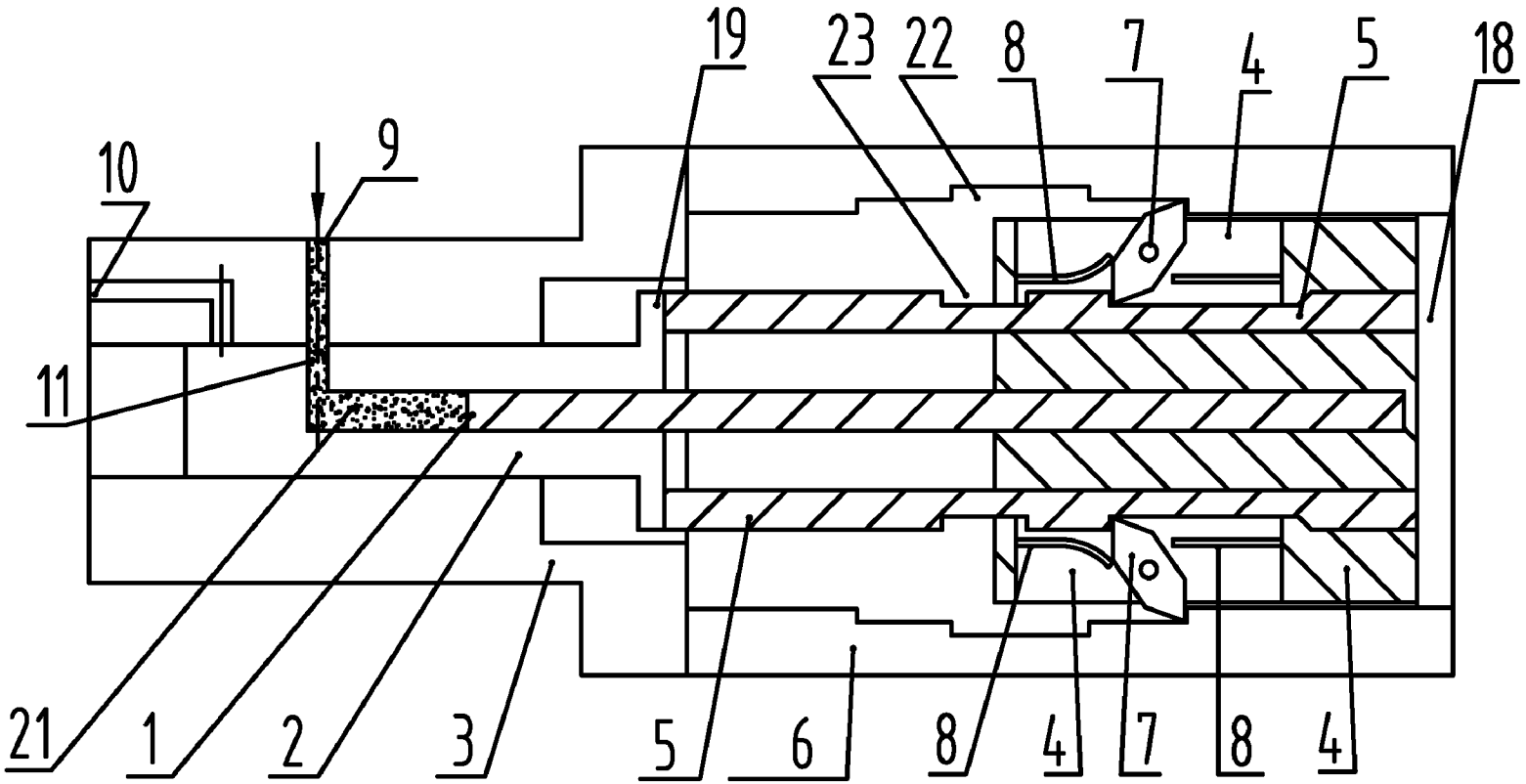
FIG. 5 is another cross-sectional view of a metering pump absorbing liquid in FIG. 3.
Figure 6:
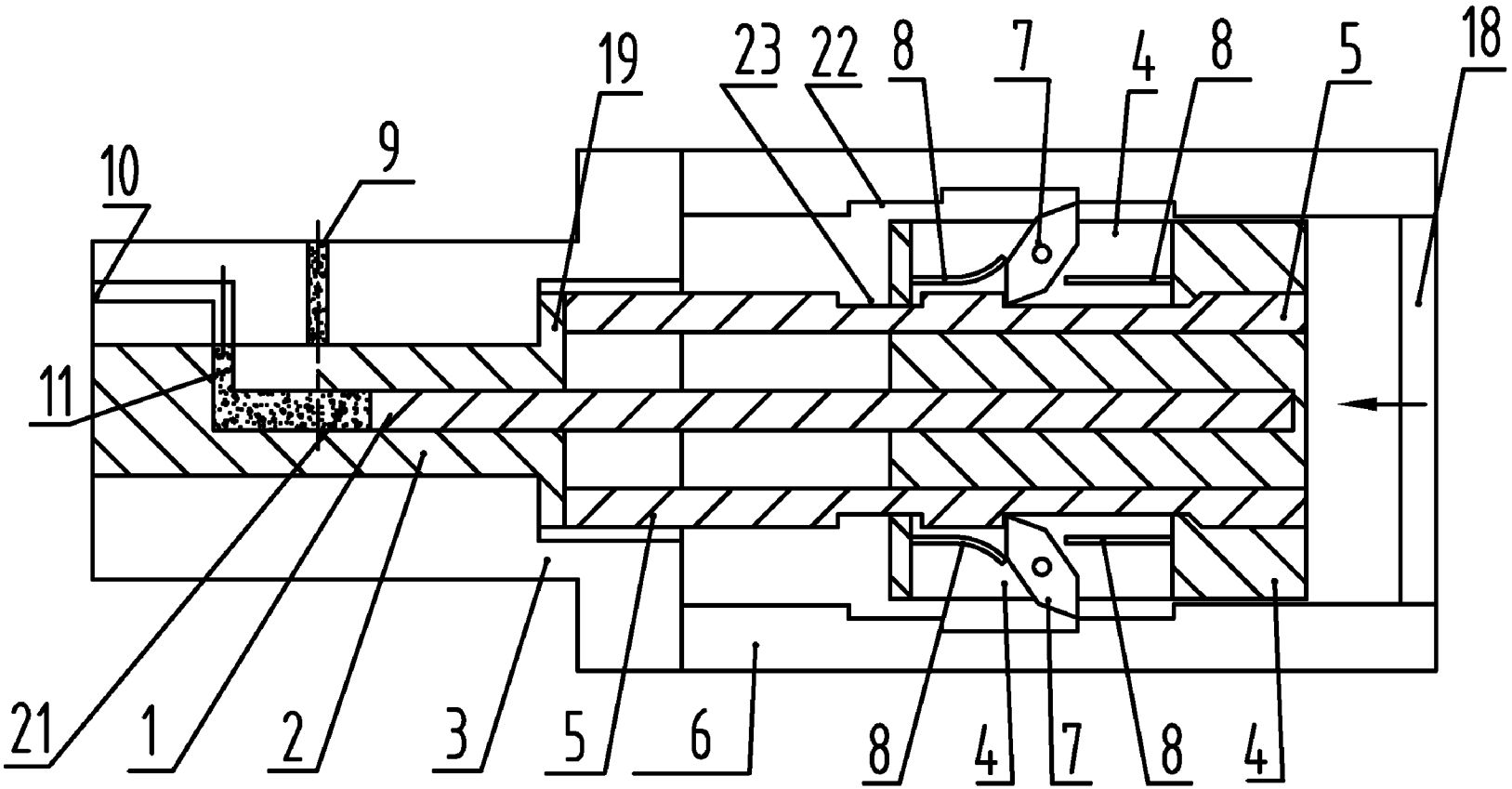
FIG. 6 is a cross-sectional view of a metering pump discharging liquid in FIG. 3.
Figure 7:
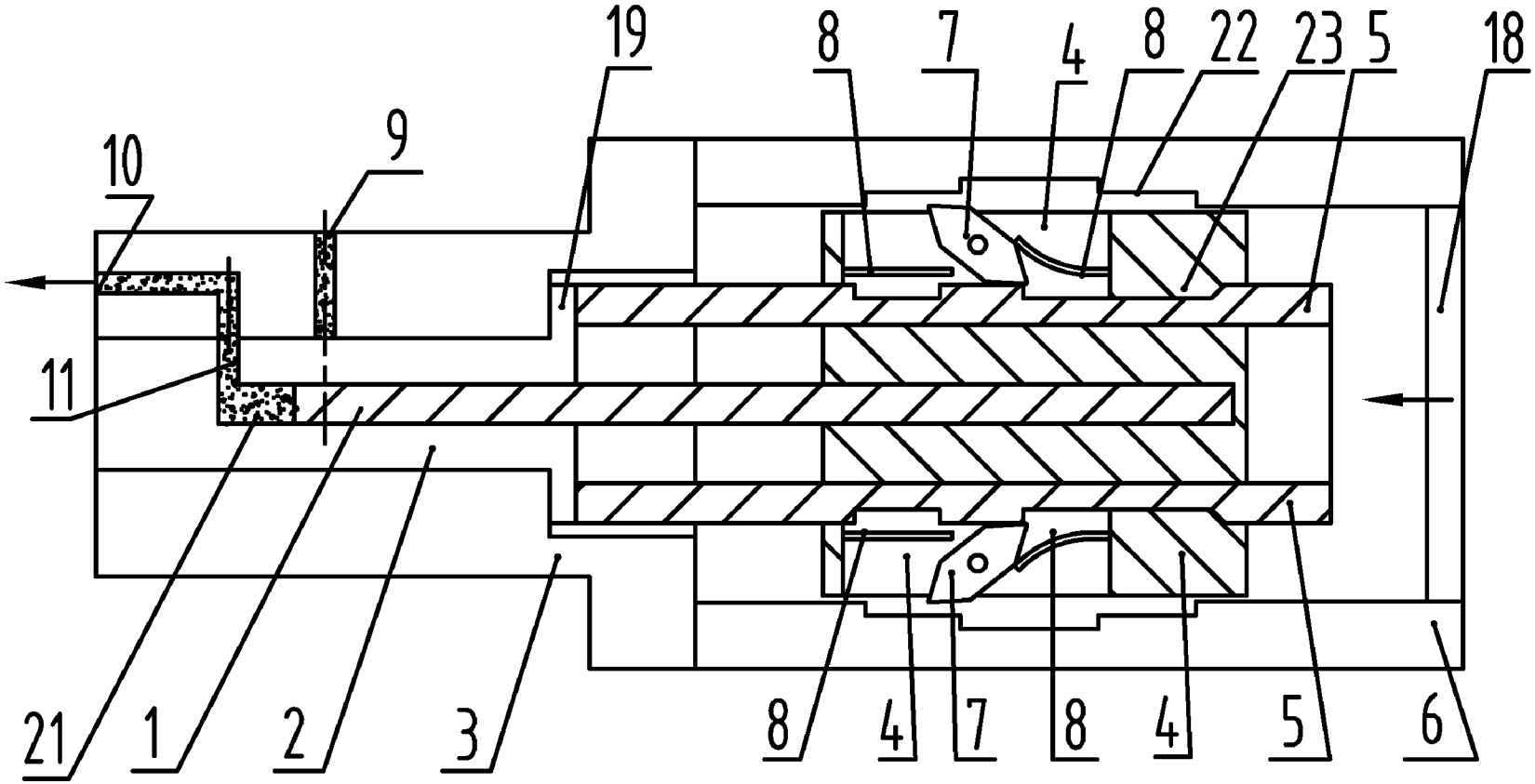
FIG. 7 is another cross-sectional view of a metering pump discharging liquid in FIG. 3.
Figure 8:
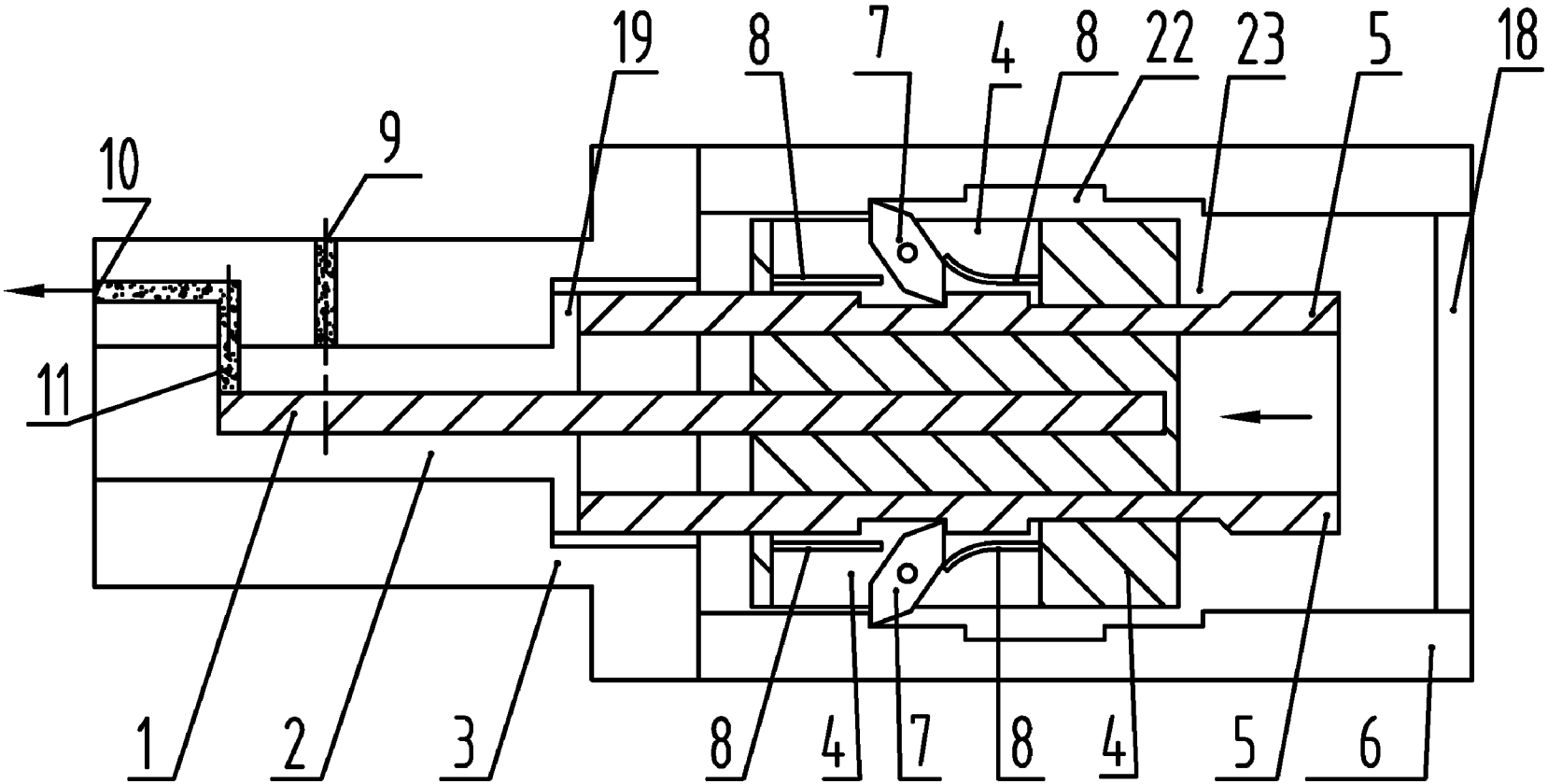
FIG. 8 is a further cross-sectional view of a metering pump discharging liquid in FIG. 3.

Operation of the metering pump of the invention comprises a liquid absorbing process and a liquid discharging process. As shown in FIGS. 3-5, during the liquid absorbing process, the pump body 2 slides from the left to the right until the diversion outlet 11 is connected to the liquid-inlet hole 9, and then the plunger 1 moves to the left in the cavity 21 and absorbs liquid. After the liquid absorbing process is completed, the liquid discharging process starts. As shown in FIGS. 6-8, the pump body 2 slides to the left in the pump sleeve 3 until the diversion outlet 11 is connected to the liquid-outlet hole 10, and then the plunger 1 moves to the right and discharges liquid in the cavity 21 from the pump body 2.

As shown in FIG. 3, a drive device of the metering pump comprises a housing 6, a rod 5, a limiting device, a sliding block 4, a rotating block 7, a pair of springs 8, a pair of first grooves 23, and a second groove 22.

The housing 6 is fixedly connected to the pump sleeve 3.

The rod 5 is fixed to the pump body 2.

The limiting device comprises a limiting block 18 and a limiting ring 19. The limiting ring 19 is disposed on a tail-end of the pump body 2, and cooperates with the pump sleeve 3 to limit leftward movement of the pump body 2, and the limiting block 18 is disposed to the right of the housing 6, and operates to limit rightward movement of the rod 5. The limiting ring 19 cooperates with the limiting block 18 to limit movement of the pump body 2 in the pump sleeve 3.

The plunger 1 is fixedly connected to the sliding block 4.

The sliding block 4 is movably disposed in the housing 6.

The rod 5 passes through the sliding block 4.

An axis is disposed on the sliding block 4 between the rod 5 and the housing 6.

The rotating block 7 is disposed on the axis, and the springs 8 are disposed on both sides of the rotating block 7.

The top of the spring 8 is contacted with one side of the rotating block 7.

The first grooves 23 are disposed on one side of the rod 5 opposite to the housing 6.

The second groove 22 is disposed on inner side of the housing 6 opposite to the first groove 23, and a middle part of the second groove 22 is lower than other parts thereof.

One end of the rotating block 7 slides in the second groove 22, and the other end of the rotating block 7 slides in and between the first grooves 23

The sliding block 4 is driven by a motor 12 via linkage parts and moves reciprocally. The linkage parts comprise a runner 13 disposed on a rotating shaft of the motor 12, and an axle pin 14 disposed on the edge of the runner 13.

Figure 9:
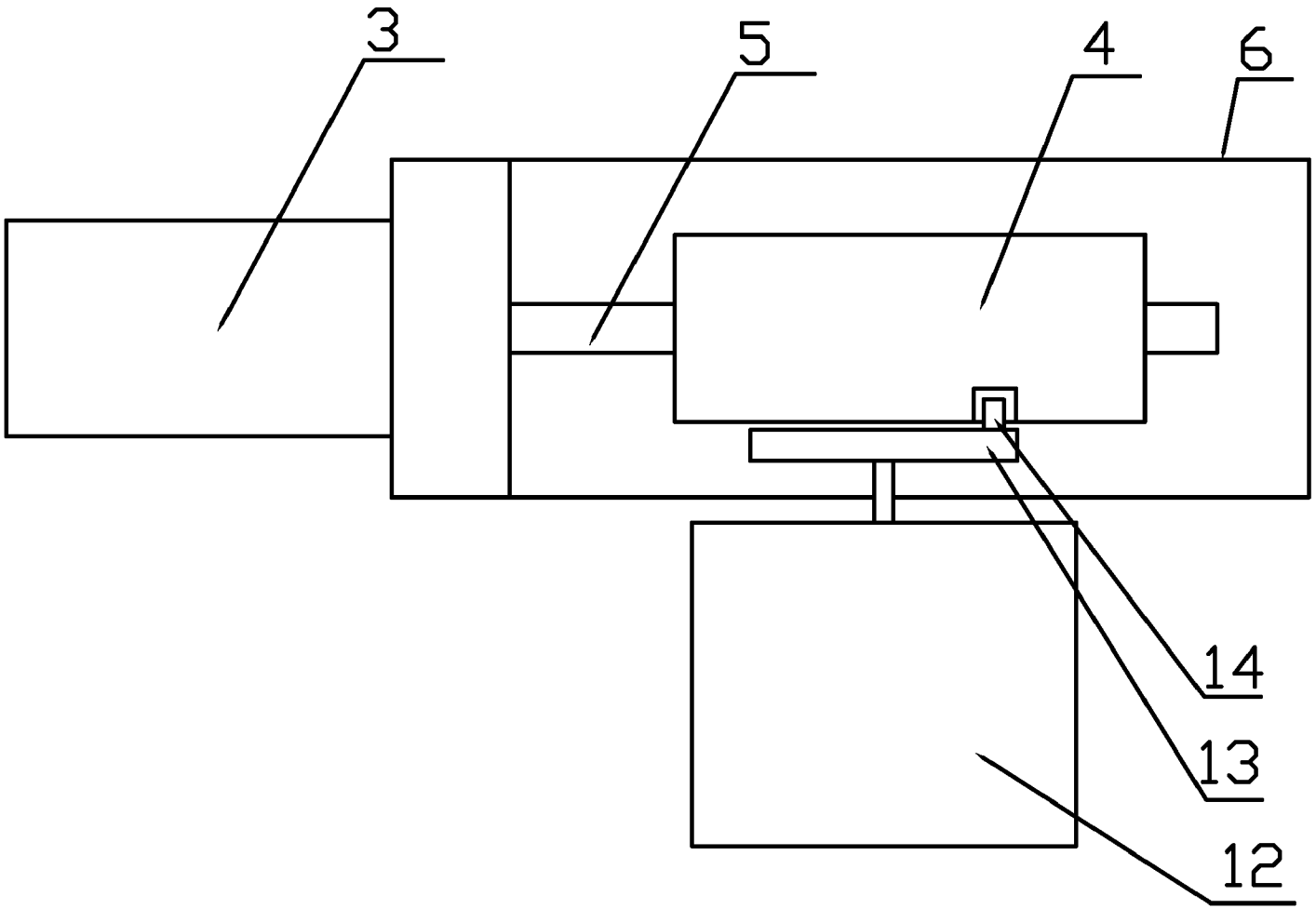
FIG. 9 is a schematic view of a metering pump with a drive device.

As shown in FIG. 9, the other end of the axle pin is fit on the sliding block 4.

As shown in FIG. 3, preferably, the middle of a cross section of the rotating block 7 is rectangular, and the other ends of the cross section of the rotating block 7 are triangular.

To maintain force equilibrium of the rod 5, the rod 5 and the rotating block 7 are symmetrically distributed in the housing 6 with respect to the plunger 1.

Operation principle of the drive device is as follows:

As the motor 12 rotates, the axle pin 14 at the edge of the runner 13 drives the sliding block 4 to move reciprocally in the housing 6. As the motor 12 rotates for one circle, the sliding block 4 finishes reciprocal movement for one time, and a liquid absorbing process and a liquid discharging process are completed.

As shown in FIGS. 3-5, during the liquid absorbing process, the sliding block 4 moves to the right, and both ends of the rotating block 7 on the sliding block 4 are respectively disposed in the second groove 22 in the housing 6 and the first groove 23 on the rod 5. Since a distance between a left part of the second groove 22 in the housing 6 and the rotating block 7 is too small, the rotating block 7 is limited by the left part of the second groove 22 and cannot rotate, and is buckled on one end of the first groove 23 on the left and pushes the rod 5 to move to the right, whereby driving the pump body 2 to move along with the plunger 1. As shown in FIG. 4, as the one end of the rotating block 7 contacted with the housing 6 reaches the middle of the second groove 22, since the middle thereof is lower than two sides thereof, rotation of the rotating block 7 cannot be limited, and the rod 5 cannot move to the right under the action of the limiting block 18. At this time the diversion outlet 11 is connected to the liquid-inlet hole 9 and the liquid-outlet hole 10 is closed by the pump body 2. As shown in FIG. 5, as the sliding block 4 continues to move to the right and drives the plunger 1 to move along therewith, the plunger 1 moves with respect to the pump body 2, and the liquid absorbing process is completed. Meanwhile, the groove 23 on the left of the rod 5 pushes the rotating block 7 to rotate, one end of the rotating block 7 contacted with the rod 5 slides to the groove 23 on the right of the rod 5, the spring 8 to the left of the rotating block 7 is compressed and enables the rotating block 7 to tightly abut against the first grooves 23 on both sides thereof, and the end of the rotating block 7 contacted with the housing 6 reaches the left part of the second groove 22.

As shown in FIGS. 6-8, during the liquid discharging process, the sliding block 4 is driven by the motor 12 and moves to the left, the rotating block 7 is limited by the right part of the second groove 22 on the housing 6 and cannot rotate, and is buckled on one end of the first groove 23 on the right and pushes the rod 5 to move to the left, whereby driving the pump body 2 to move along with the plunger 1. As shown in FIG. 7, as one end of the rotating block 7 contacted with the housing 6 reaches the middle of the second groove 22 on the housing 6, since the middle thereof is lower than two sides thereof, rotation of the rotating block 7 cannot be limited, and the rod 5 cannot move to the left under the action of the limiting ring 19. At this time the diversion outlet 11 is connected to the liquid-outlet hole 10 and the liquid-inlet hole 9 is closed by the pump body 2. As shown in FIG. 8, as the sliding block 4 continues to move to the left and drives the plunger 1 to move to the left, the plunger 1 moves with respect to the pump body 2, and the liquid discharging process is completed. Meanwhile, the first groove 23 on the right of the rod 5 pushes the rotating block 7 to rotate, the end of the rotating block 7 contacted with the rod 5 reaches the first groove 23 on the left of the rod 5, the end of the rotating block 7 contacted with the housing 6 reaches the left part of the second groove 22, and the spring 8 to the right of the rotating block 7 is compressed and enables the rotating block 7 to tightly abut against the first grooves 23 on both sides thereof.

Preferably, a pump head is made of high erosion-resistant materials whereby enabling the pump to be resistant to any acid, alkaline and solution and to have wide applications.

Preferably, the motor 12 employs a synchronous motor.

Preferably, multiple metering pumps of the invention can be connected in parallel or via multiple channels.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A metering pump, comprising a pump sleeve comprising a liquid-inlet hole and a liquid-outlet hole;

a pump body comprising a cavity and a diversion outlet;

a plunger; and a drive device, comprising a housing;

a rod;

a limiting device;

a sliding block;

a rotating block;

a pair of springs;

a pair of first grooves; and a second groove;

wherein said pump body is movably disposed in said pump sleeve;

said plunger is disposed in said cavity of said pump body;

said diversion outlet is disposed on a side wall of said pump body and connected to said cavity;

said liquid-inlet hole and said liquid-outlet hole are opposite to said diversion outlet;

said diversion outlet is alternatively aligned with said liquid-inlet hole and said liquid-outlet hole;

said housing is fixedly connected to said pump sleeve;

said rod is fixed to said pump body;

said limiting device operates to limit travel distance of said pump body;

said sliding block is movably disposed in said housing;

said plunger is fixedly connected to said sliding block;

said rod passes through said sliding block;

an axis is disposed on said sliding block;

said rotating block is disposed on said axis;

said springs are disposed on both sides of said rotating block;

the top of said spring is contacted with one side of said rotating block;

said first grooves are disposed on one side of said rod opposite to said housing;

said second groove is disposed on inner side of said housing opposite to;

a middle part of said second groove is located radially outward from the centerline of the plunger;

one end of said rotating block slides in said second groove; and the other end of said rotating block slides in and between said first grooves.

2. The metering pump of claim 1, wherein said diversion outlet is disposed on a tail-end of said pump body.

3. The metering pump of claim 1, wherein a sealing ring is disposed on inner side of said pump sleeve, and operates to fix said pump body to said pump sleeve.

4. The metering pump of claim 1, wherein a sealing strip is disposed on inner side of said pump sleeve, and operates to fix said pump body to said pump sleeve.

5. The metering pump of claim 1, wherein a sealing loop is disposed between an inner wall of said cavity and said plunger.

6. The metering pump of claim 1, wherein an elastic device is disposed between said pump body and said pump sleeve and opposite to said liquid-inlet hole and said liquid-outlet hole.

7. The metering pump of claim 6, wherein a thread hole is disposed on said pump sleeve and at the bottom of said elastic device; and an adjusting screw is disposed in said thread hole.

8. The metering pump of claim 1, wherein said sliding block is driven via linkage parts and moves reciprocally.

9. The metering pump of claim 8, wherein said linkage parts comprise a runner disposed on a rotating shaft of a motor, and an axle pin disposed on the edge of said runner.

10. The metering pump of claim 9, wherein the other end of said axle pin is fit on said sliding block.

11. The metering pump of claim 1, wherein said rod comprises two rods; and said rods are symmetrically distributed with respect to said plunger.

12. The metering pump of claim 1, wherein the middle of a cross section of said rotating block is rectangular; and the other ends of said cross section of said rotating block are triangular.

13. A drive device, comprising a housing;

a rod;

a limiting device;

a sliding block;

a rotating block;

a pair of springs;

a pair of first grooves; and a second groove;

wherein said rod passes through said sliding block;

an axis is disposed on said sliding block;

said rotating block is disposed on said axis;

said springs are disposed on both sides of said rotating block;

the top of said spring is contacted with one side of said rotating block;

said first grooves are disposed on one side of said rod opposite to said housing; and said second groove is disposed on inner side of said housing opposite to one of said first grooves;

a middle part of said second groove is located radially outward from the centerline of the plunger;

one end of said rotating block slides in said second groove; and the other end of said rotating block slides in and between said first grooves.

14. The drive device of claim 13, wherein said sliding block is driven via linkage parts and moves reciprocally.

15. The drive device of claim 14, wherein said linkage parts comprise a runner disposed on a rotating shaft of a motor, and an axle pin disposed on the edge of said runner.

16. The drive device of claim 15, wherein the other end of said axle pin is fit on said sliding block.

17. The drive device of claim 13, wherein said rod comprises two rods; and said rods are symmetrically distributed with respect to said plunger.

18. The drive device of claim 13, wherein the middle of a cross section of said rotating block is rectangular; and the other ends of said cross section of said rotating block are triangular.

19. The drive device of claim 13, wherein said limiting device comprises a limiting block and a limiting ring;

said limiting ring is disposed on a tail-end of said pump body, and cooperates with said pump sleeve to limit movement of said pump body; and said limiting block is disposed to the right of said housing, and operates to limit movement of said rod.

* * * * *